US008969797B2

(12) United States Patent
Fujita

(10) Patent No.: US 8,969,797 B2
(45) Date of Patent: Mar. 3, 2015

(54) MS/MS TYPE MASS SPECTROMETER

(71) Applicant: Shimadzu Corporation, Kyoto-shi, Kyoto (JP)

(72) Inventor: Shinjiro Fujita, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/662,531

(22) Filed: Oct. 28, 2012

(65) Prior Publication Data

US 2014/0117227 A1 May 1, 2014

(51) Int. Cl.
*H01J 49/26* (2006.01)

(52) U.S. Cl.
CPC ..... *H01J 49/26* (2013.01)
USPC ..... 250/286; 250/281; 250/282

(58) Field of Classification Search
USPC ..... 250/281, 282, 286, 287
See application file for complete search history.

(56) References Cited

U.S. PATENT DOCUMENTS

| | | | | |
|---|---|---|---|---|
| 8,384,028 | B2 * | 2/2013 | Fujita et al. | 250/293 |
| 2009/0294642 | A1 * | 12/2009 | Brown | 250/282 |
| 2011/0042565 | A1 * | 2/2011 | Bateman et al. | 250/287 |

FOREIGN PATENT DOCUMENTS

| | | | |
|---|---|---|---|
| JP | 7-201304 | A | 8/1995 |
| WO | 2009/095958 | A1 | 8/2009 |

* cited by examiner

*Primary Examiner* — Nicole Ippolito
*Assistant Examiner* — Hanway Chang
(74) *Attorney, Agent, or Firm* — Sughrue Mion, PLLC

(57) ABSTRACT

The length of a delay time d from a suspension period starting point t1 until the application of a pulse voltage is begun is changed according to the length of the suspension period during which no data is collected at the time of m/z switching. It is thus ensured that the amount of product ions can be reliably restored at a suspension period termination point t2. In addition, the peak value of the pulse voltage is also changed according to the ionic strength immediately before entering the suspension period. The ion removal rate is thus increased when the amount of remaining ions is high, and the amount of remaining ions is reliably brought to zero within the same pulse width. As a result, crosstalk can be completely removed.

6 Claims, 9 Drawing Sheets

(FIG. 1)
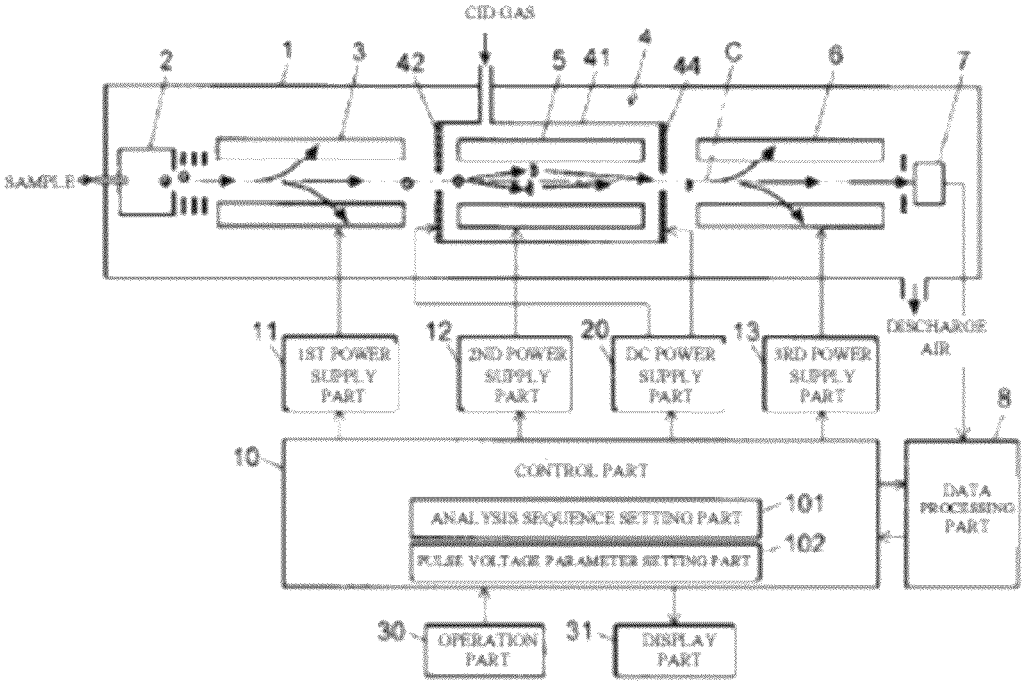
(FIG. 2)
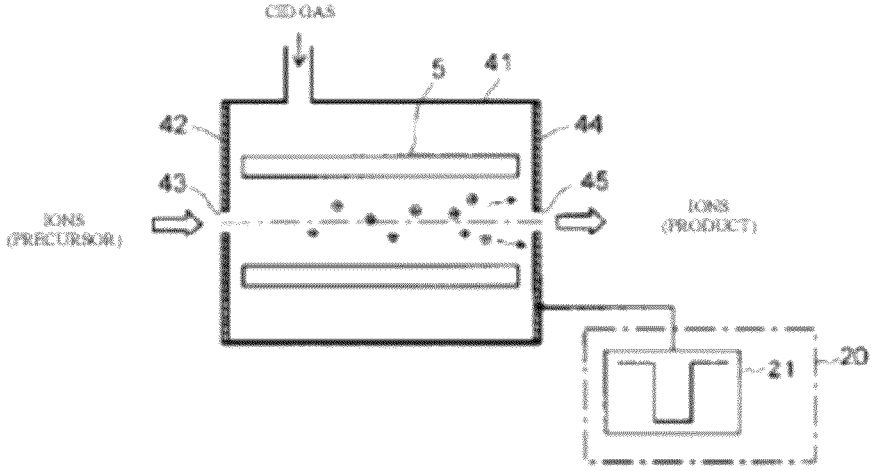

(FIG. 3)
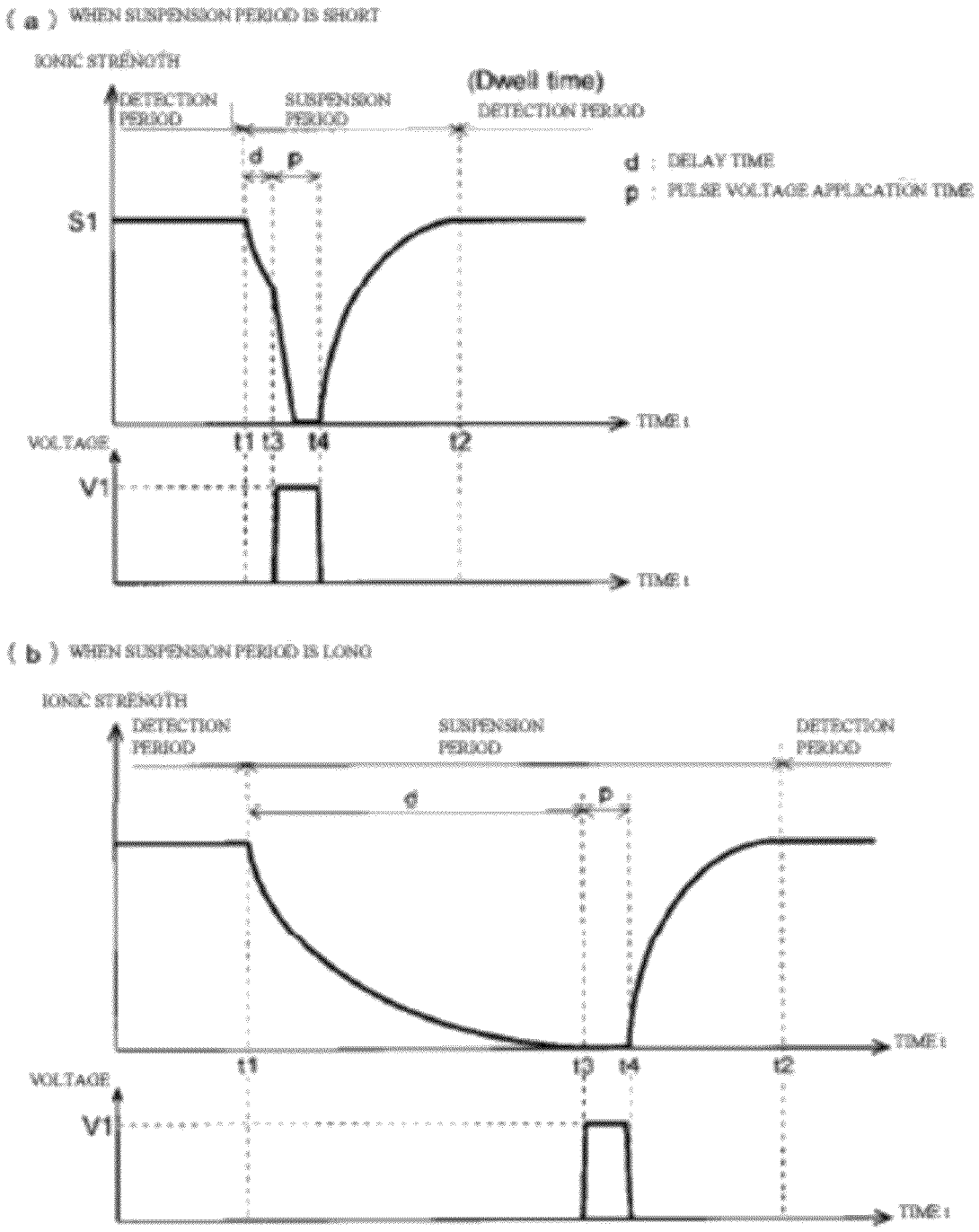

(FIG. 4)
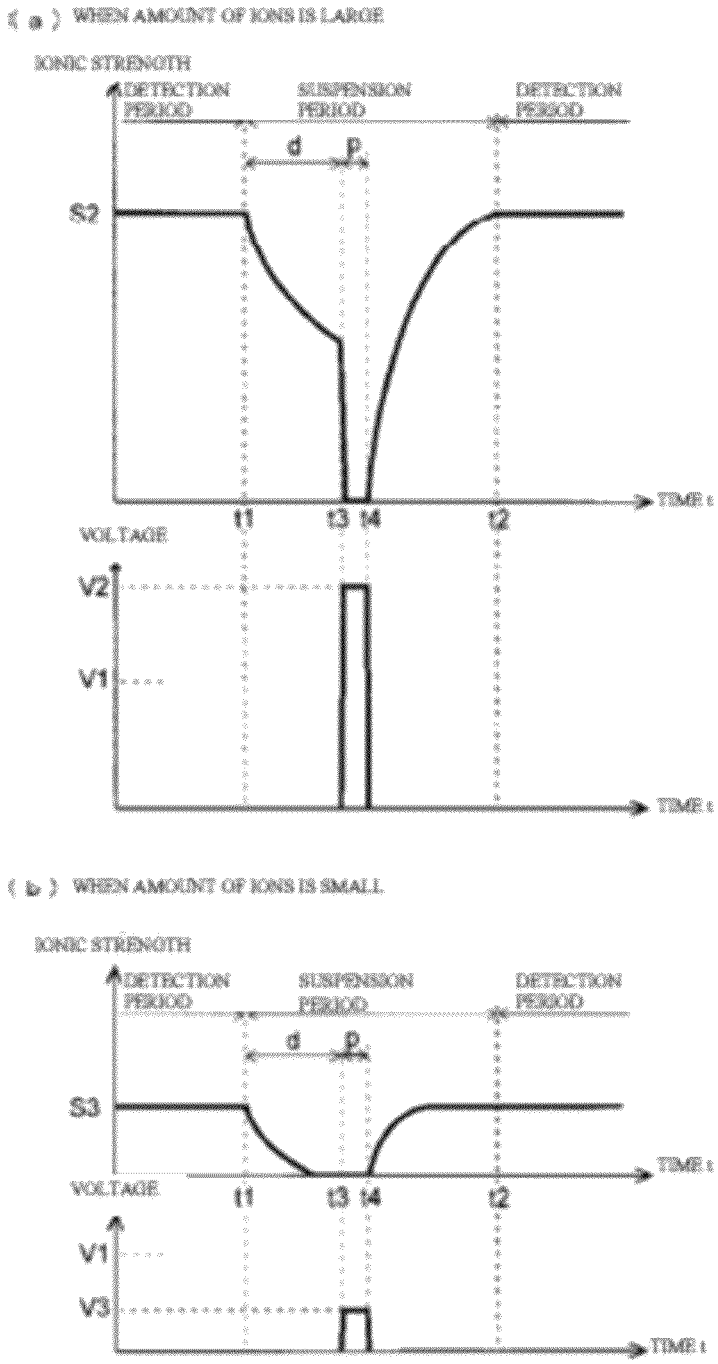

(FIG. 5)
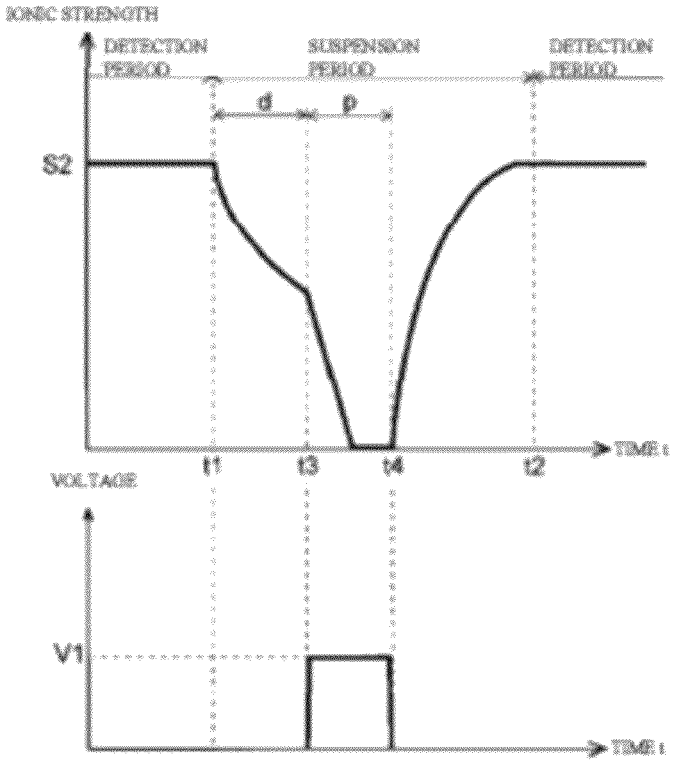

(FIG. 6)
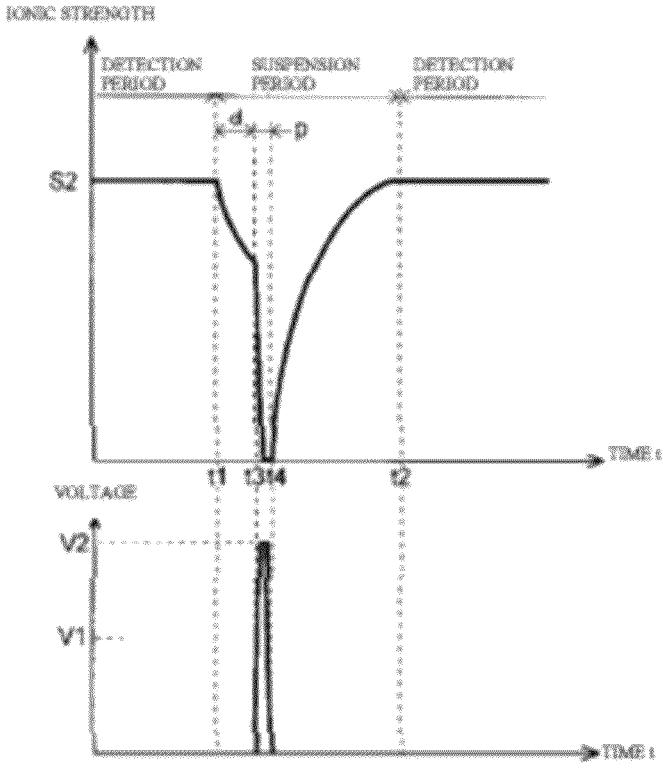
(FIG. 7)
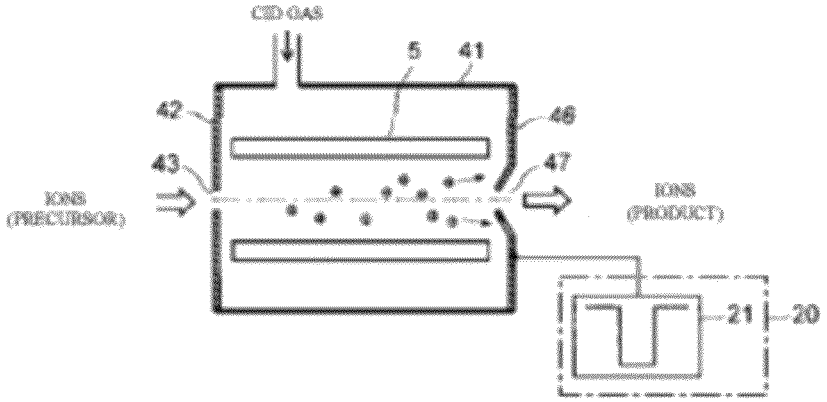

(FIG. 8)
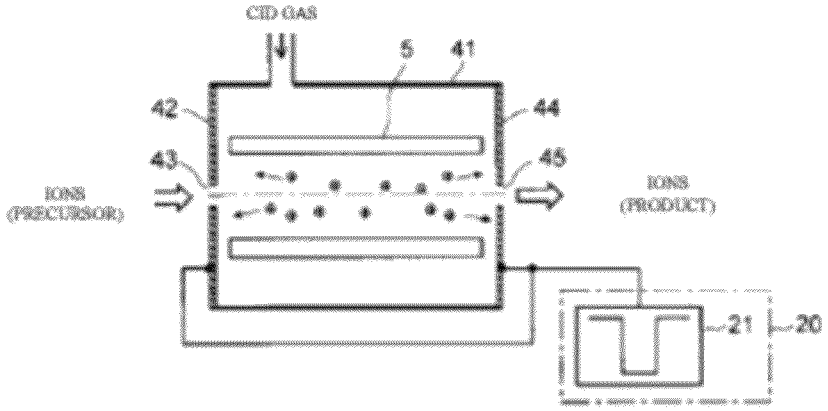
(FIG. 9)
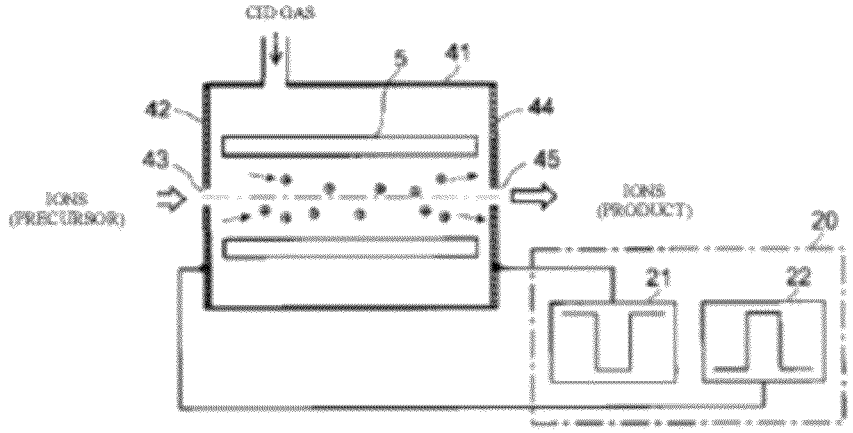

(FIG. 10)
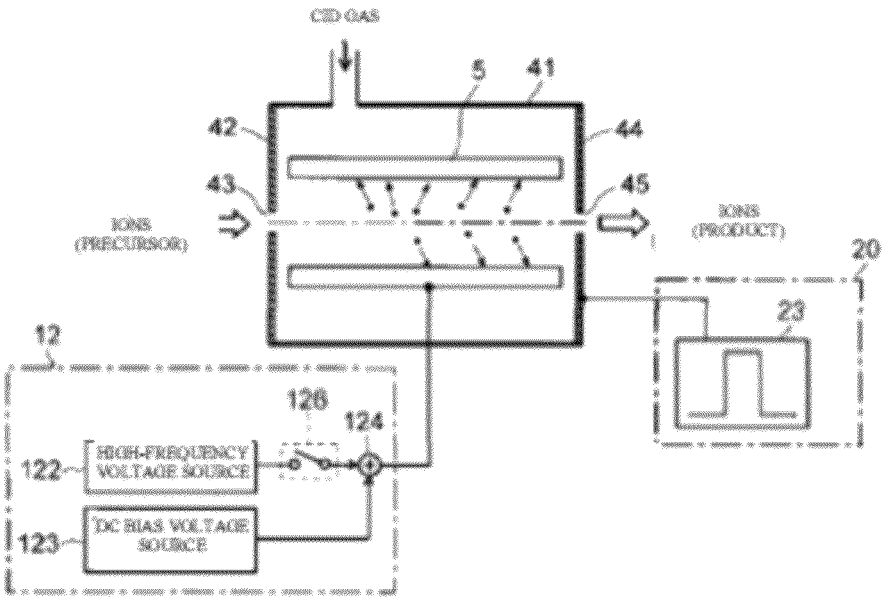
(FIG. 11)
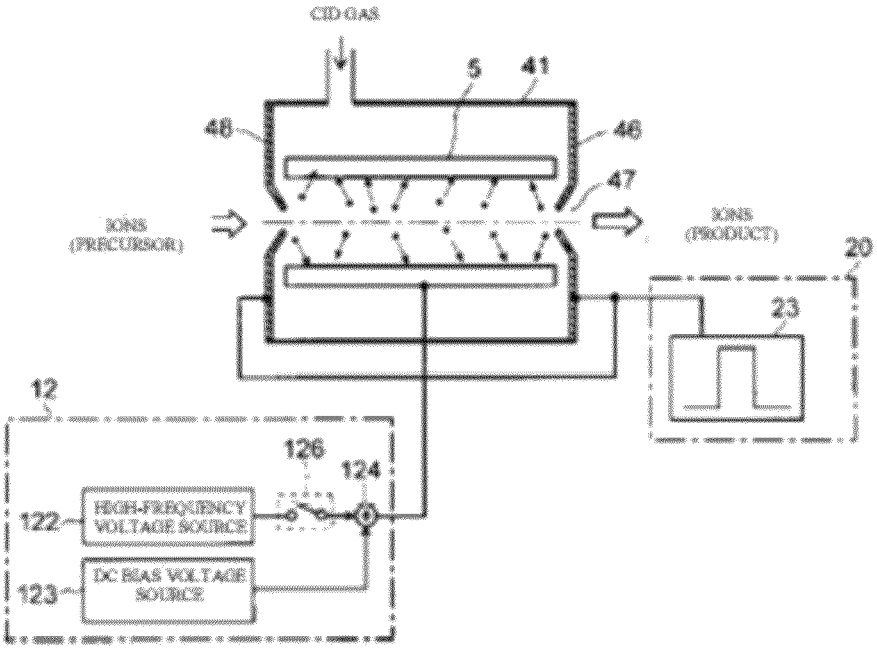

(FIG. 12)
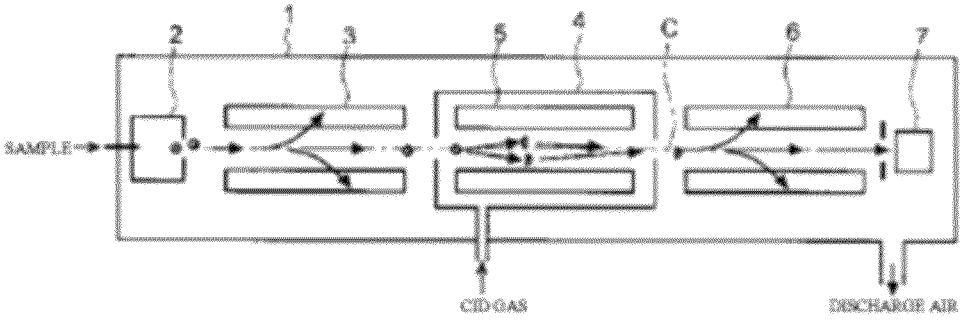
(FIG. 13)
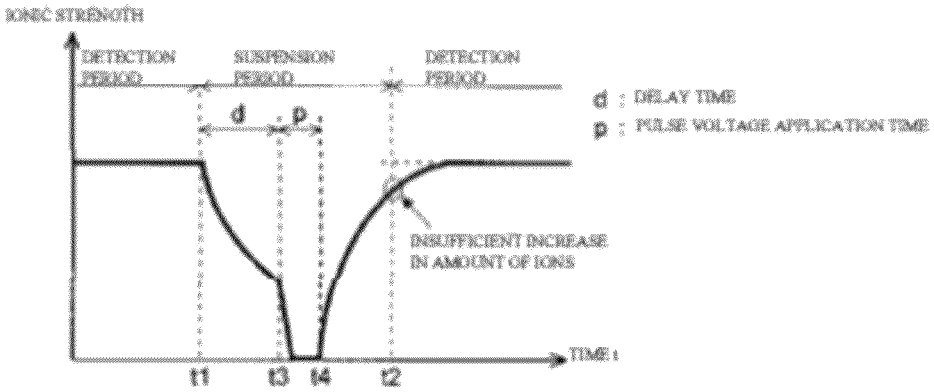

(FIG. 14)
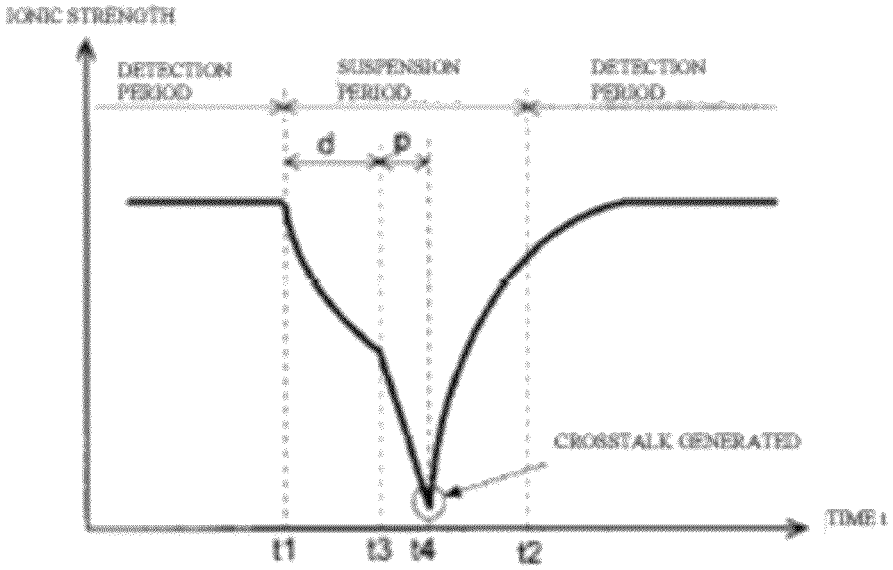

MS/MS TYPE MASS SPECTROMETER

BACKGROUND OF THE INVENTION

1. Field of the Invention

The present invention relates to an MS/MS type mass spectrometer which splits ions having a specific mass-to-charge ratio (m/z) by collision-induced dissociation (CID) and performs mass spectrometry on the product ions (fragment ions) produced as a result.

2. Description of the Background Art

One known method of performing mass spectrometry in order to identify or analyze the structure of a substance with a large molecular weight is MS/MS analysis (also called tandem analysis). A typical MS/MS mass spectrometer is a triple quadrupole (TQ) type mass spectrometer. FIG. 12 is a schematic configuration diagram of a general triple quadrupole type mass spectrometer disclosed in Patent Literature 1 or the like.

This mass spectrometer is provided with an ion source 2 for ionizing a sample to be analyzed, three levels of quadrupoles 3, 5, and 6, each consisting of four rod electrodes, and a detector 7 for detecting ions and outputting a detection signal corresponding to the amount of ions inside an analysis chamber 1 which is vacuum-pumped by a vacuum pump not shown in the drawing. A voltage combining a direct-current voltage and a high-frequency voltage is applied to the first quadrupole 3, and only target ions having a prescribed mass-to-charge ratio are selected as precursor ions from among various ions produced by the ion source 2 due to the action of an electric field generated as a result of this voltage.

The second quadrupole 5 is housed inside a collision cell 4 with a high degree of air-tightness. A CID gas such as argon (Ar), for example, is introduced into this collision cell 4. The precursor ions sent from the first quadrupole 3 to the second quadrupole 5 collide with the CID gas inside the collision cell 4, which causes splitting due to collision-induced dissociation and produces product ions. There are various forms of this splitting, so a plurality of types of product ions with different mass-to-charge ratios are normally produced from precursor ions of one type. These various product ions exit the collision cell 4 and are introduced into the third quadrupole 6. Ordinarily, only a high-frequency voltage is applied or a voltage generated by adding a direct-current bias voltage to a high-frequency voltage is applied to the second quadrupole 5, and this second quadrupole 5 functions as an ion guide for transporting ions to the next level while converging the ions.

As in the case of the first quadrupole 3, a voltage combining a direct-current voltage and a high-frequency voltage is applied to the third quadrupole 6. Only product ions having a specific mass-to-charge ratio are selected by the third quadrupole 6 so as to reach the detector 7 due to an electric field generated as a result of this voltage. By appropriately changing the direct-current voltage and the high-frequency voltage applied to the third quadrupole 6, it is possible to scan the mass-to-charge ratios of ions which may pass through the third quadrupole 6 (product ion scan). In this case, a data processing part not shown in the drawing can create a mass spectrum (MS/MS spectrum) of product ions generated by the splitting of the target ions based on a detection signal obtained by the detector 7. In addition, it is also possible to execute a precursor ion scan to search for all precursor ions producing specific product ions or a neutral loss scan to search for all precursor ions for which a specific partial structure has been lost.

In an LC/MS/MS or GC/MS/MS device using the MS/MS type mass spectrometer described above as a detector for liquid chromatography (LC) or gas chromatography (GC), a technique called MRM (Multiple Reaction Monitoring) is often used to perform simultaneous analysis (identification and assay) of multiple components contained in a sample. In MRM measurements, product ions having a specific one or a plurality of mass-to-charge ratios are selected by the third quadrupole 6 in a state in which the mass-to-charge ratio of precursor ions selected by the first quadrupole 3 is fixed, and the signal strength of these product ions is measured. Since the plurality of components contained in the sample separate over time in LC or GC, it is possible to find the signal strength of ions derived from each component with high precision and high sensitivity by changing the mass-to-charge ratios of the precursor ions and the product ions in accordance with the elution time (retention time) of each component.

In MRM measurements, the detection of a pair of one given precursor ion and one given product ion is performed successively as time passes, but significant data cannot be obtained at the time of the switching of the mass-to-charge ratios. Therefore, as shown in FIGS. 13 and 14, a suspension time of an appropriate length is set between the data collection for a given pair of a precursor ion and a product ion and the next pair of a precursor ion and a product ion. FIGS. 13 and 14 are drawings which schematically show the changes in ionic strength over time due to the remaining ions in the collision cell 4.

In a mass spectrometer with the configuration described above, a CID gas is fed into the collision cell 4, so the gas pressure inside the collision cell 4 is typically higher at approximately mTorr than the gas pressure outside the collision cell 4. When ions advance through a high-frequency electric field in an atmosphere with such a comparatively high gas pressure, the kinetic energy of the ions is attenuated and the speed of the ions decreases due to collision with the gas.

In MRM measurements, if the speed of advancement of ions decreases in the collision cell 4 as described above, when the mass-to-charge ratio of the precursor ions is switched from a given value M1 to another value M2, ions of the previous mass-to-charge ratio M1 and product ions derived from these ions still remain in the collision cell 4 in spite of the introduction of ions of the switched mass-to-charge ratio M2 into the collision cell 4 having been started, and there is a risk that these ions may mix. This is a phenomenon called crosstalk in MS/MS analysis, and when there is crosstalk, the assay properties and the like of the target component are diminished.

Therefore, in the mass spectrometer described in Patent Literature 2, a pulse voltage is applied to the lens electrode on the inlet side or the outlet side of the collision cell 4 in the suspension period during which the mass-to-charge ratio of the precursor ions is switched, and ions are attracted to and made to collide with the lens electrode due to the action of an electric field formed temporarily inside the collision cell as a result of the pulse voltage. As a result, it is possible to remove from within the collision cell 4 precursor ions with the previous mass-to-charge ratio and the product ions derived from the precursor ions before the precursor ions with the switched mass-to-charge ratio are introduced into the collision cell 4, which makes it possible to avoid crosstalk.

However, when a pulse voltage for ion removal is applied to the lens electrode in a state in which a large amount of ions remain in the collision cell 4, the amount of ions colliding with the lens electrode becomes large, and the contamination of the lens voltage worsens. In order to minimize this contamination, in the device described in Patent Literature 2, a pulse voltage for ion removal is applied to the lens electrode with a delay of a prescribed amount of time from the starting point of the suspension period. That is, as shown in FIGS. 13 and 14, a pulse voltage with a pulse width of p (=t4−t3) is applied to the lens electrode at a point t3 when a prescribed delay time d has passed from a point t1 when the suspension period was begun. During the delay time d, the ions in the collision cell 4 are discharged little by little to the outside. Therefore, the amount of ions remaining inside the collision cell 4 is reduced at the point t3 when the pulse voltage is applied, and there are few collisions between the ions and the lens electrode when the pulse voltage is applied, which makes it possible to reduce the contamination of the lens electrode.

As described above, data based on the detection signal of the detector 7 is not collected during the suspension period, and the collection of data is resumed at the termination point t2 of the suspension period. Therefore, the suspension period is wasted time in the measurements, and it is preferable for the suspension time to be shorter in order to improve the throughput of the measurements. In addition, when the sample components change with the passing of time, as in the case of LC/MS/MS or GC/MS/MS, it is preferable for the suspension time to be shorter in order to prevent the missed detection of components. However, a short suspension time leads to the following such problems.

Specifically, as shown in FIG. 13, after a pulse voltage is applied during the suspension period so that practically all of the ions remaining in the collision cell are temporarily removed, the product ions derived from the next precursor ions begin to accumulate in the collision cell 4, so the amount of ions in the collision cell 4 gradually rises from the termination point t4 of the application of the pulse voltage. Only when these ions pass through the third quadrupole 6 and reach the detector 7 can an ionic strength based on the product ions derived from the precursor ions after the switching of the mass-to-charge ratio be obtained. Therefore, the rise of the detected ionic strength takes a certain amount of time, and if the suspension period is too short, the amount of ions incident on the detector 7 may not have yet sufficiently recovered at the starting point t2 of the detection period for collecting data next. In such a situation, the measurement sensitivity decreases in the initial stages of the detection period.

On the other hand, if the amount of ions remaining in the collision cell 4 is too large at the point t1 when the suspension period is begun, as shown in FIG. 14, the remaining ions are not completely removed (the strength does not reach zero) during the period in which the pulse voltage is applied to the lens electrode, and the product ions derived from the next precursor ions begin to accumulate while some ions still remain. In such a situation, it becomes impossible to completely eliminate crosstalk.

PRIOR ART LITERATURES (PATENT LITERATURE 1) Japanese Unexamined Patent Application Publication H7-201304

(PATENT LITERATURE 2) International Publication No. 2009/095958 Pamphlet

SUMMARY OF THE INVENTION

The present invention was conceived in order to solve the problems described above, and its purpose is to provide an MS/MS type mass spectrometer capable of reliably removing unnecessary ions remaining in a collision cell, regardless of the length of a suspension period accompanying a switch in the mass-to-charge ratio of precursor ions, and performing measurements with high sensitivity by preventing insufficient amounts of the product ions derived from next precursor ions at the termination point of the suspension period.

Another purpose of the present invention is to provide an MS/MS type mass spectrometer which, even if there is a large amount of ions remaining in a collision cell due to reasons such as a high concentration of components in the sample to be measured, for example, is capable of completely eliminating crosstalk by reliably removing the ions during a suspension period.

The first invention conceived in order to solve the problems described above is an MS/MS type mass spectrometer equipped with a first mass separating part for selecting ions having a specific mass-to-charge ratio as precursor ions from among various ions, a collision cell for splitting the ions by causing the precursor ions to collide with a prescribed gas, the collision cell having an ion guide for converging and transporting ions with a high-frequency electric field, a second mass separating part for selecting ions having a specific mass-to-charge ratio from among various product ions produced by the splitting of the precursor ions, and a detector for detecting the product ions selected by the second mass separating part, the MS/MS type mass spectrometer being provided with:

a) a lens electrode having an ion-passing opening provided on at least one of the inlet side and outlet side of the collision cell;

b) a voltage application means for applying a pulse voltage for attracting or repelling the ions in the collision cell to the lens electrode on the inlet side and/or the outlet side; and c) a control means which controls the voltage application means so as to generate a pulse voltage during a suspension period in which the convergence of detection data by the detector is suspended in step with the switching of the mass-to-charge ratio of precursor ions in the first mass separating part at a point when a prescribed delay time has passed after the starting point of the suspension period and regulates the length of the delay time according to the length of the suspension time.

The second invention conceived in order to solve the problems described above is an MS/MS type mass spectrometer equipped with a first mass separating part for selecting ions having a specific mass-to-charge ratio as precursor ions from among various ions, a collision cell for splitting the ions by causing the precursor ions to collide with a prescribed gas, the collision cell having an ion guide for converging and transporting ions with a high-frequency electric field, a second mass separating part for selecting ions having a specific mass-to-charge ratio from among various product ions produced by the splitting of the precursor ions, and a detector for detecting the product ions selected by the second mass separating part, the MS/MS type mass spectrometer being provided with:

a) a lens electrode having an ion-passing opening provided on at least one of the inlet side and outlet side of the collision cell;

b) a voltage application means for applying a pulse voltage for attracting or repelling the ions in the collision cell to the lens electrode on the inlet side and/or the outlet side; and c) a control means which controls the voltage application means so as to generate a pulse voltage during a suspension period in which the convergence of detection data by the detector is suspended in step with the switching of the mass-to-charge ratio of precursor ions in the first mass separating part and regulates at least one of the peak value or the pulse width of the pulse voltage based on information reflecting the amount of remaining ions in the collision cell immediately before entering the suspension period.

In the MS/MS type mass spectrometer of the second invention, it is preferable to add a means for detecting the amount of space charge in the collision cell in order to accurately find the amount of ions remaining in the collision cell, but from a practical standpoint, the information reflecting the amount of remaining ions should be found based on the ionic strength (that is, the detection signal) obtained from the detector. For example, in the case of MRM measurements, the mass-to-charge ratio of precursor ions or product ions is ordinarily determined according to the components to be measured, so the ionic strength obtained by the detector can be considered to be roughly proportional to the amount of ions remaining in the collision cell. Accordingly, in this case, the control means should regulate at least one of the peak value or the pulse width of the pulse voltage according to the ionic strength.

In the MS/MS type mass spectrometers of the first and second inventions, the control means applies a pulse voltage with the reverse polarity of that of the ions remaining in the collision cells to the lens electrode on the outlet side with the voltage application means, for example, during the suspension period when no detection data is collected. Due to the electric field formed by this applied voltage, the ions remaining in the collision cell are accelerated toward the lens electrode on the outlet side. The accelerated ions collide with the lens electrode on the outlet side, receive electrons, and are neutralized. In this way, unnecessary ions remaining in the collision cell are rapidly removed.

Since the suspension period is a period during which essentially no measurements are performed, it is necessary to shorten the suspension period in order to increase the throughput of the measurements. It is also necessary to shorten the suspension period when it is necessary to successively measure different components in short time intervals. Conversely, when there is sufficient flexibility in the measurement time or when there are open time intervals in which different components arrive, the suspension period can be lengthened. That is, the length of the suspension period can be variously adjusted according to the purpose or the conditions of the measurements. Therefore, in the MS/MS type mass spectrometer of the first invention, the control means regulates the delay time so that the delay time becomes relatively long as the length of the suspension period increases. In other words, this means that the delay time is regulated so that the time from the point when the application of the pulse voltage is terminated (termination point of the removal operation for ions remaining in the collision cell) during the suspension period to the point when the suspension period ends and data collection is begun is set to at least a certain prescribed value.

Since the product ions derived from the next precursor ions start to be sent from the collision cell from the point when the application of the pulse voltage ends, the amount of product ions detected by the detector gradually increases. Although a short amount of time is required until the effects of ion removal in the collision cell are completely dispelled in the detector, as described above, the time from the termination point of the pulse voltage application during the suspension period until the termination point of the suspension period is sufficiently secured, regardless of the length of the suspension period, so the amount of ions reaching the detector has sufficiently recovered by the termination point of the suspension period. As a result, even if the suspension period is shortened in order to improve the measurement throughput or to avoid the missed detection of sample components, it is possible to keep the ion detection sensitivity sufficiently high immediately after the switching of the precursor ions.

On the other hand, by lengthening the suspension time when there is sufficient flexibility in the measurement time or when the time intervals in which sample components are introduced are wide, the amount of ions remaining in the collision cell becomes roughly zero at the point when the pulse voltage is applied to the lens electrode, so it is possible to keep the ion detection sensitivity sufficiently high immediately after the switching of the precursor ions and to reduce the contamination of the lens electrode or the ion guide due to the adhesion of ions.

As described above, when attempting to remove ions remaining in the collision cell by applying a pulse voltage to the lens electrode during the suspension period, the rate of removal depends on the peak value of the pulse voltage. In addition, if the peak value of the pulse voltage is constant, the amount of remaining ions removed increases as the pulse width becomes wider (as the application time of the pulse voltage becomes longer). Therefore, in the MS/MS type mass spectrometer of the second invention, the control means regulates the parameters of the voltage so that the peak value of the pulse voltage becomes relatively larger or the pulse width of the pulse voltage (voltage application time) becomes relatively longer as the amount of remaining ions increases according to the information reflecting the amount of ions remaining in the collision cell immediately before entering the suspension period.

The kinetic energy provided to the ions in the collision cell increases as the peak value of the pulse voltage increases, and the removal rate of ions increases by a commensurate amount. Therefore, even if the amount of ions remaining in the collision cell is large, the ions can be removed in a short amount of time. On the other hand, by widening the pulse width even if the peak value of the pulse voltage does not change, it is possible to reliably remove the ions even when the amount of ions remaining in the collision cell is large. As a result, it is possible to introduce the next precursor ions into the collision cell in a state in which the precursor ions remaining in the collision cell and the product ions derived from these precursor ions have been almost completely removed, so it is possible to almost completely eliminate crosstalk, regardless of the amount of remaining ions when entering the suspension period.

In the MS/MS type mass spectrometers of the first and second inventions, various modes can be employed for the mode of application of the pulse voltage for removing the ions remaining in the collision cell, such as that disclosed in Patent Literature 2. That is, the voltage application means may be configured so as to apply a pulse voltage with the reverse polarity as the ions in the collision cell only to the lens electrode on the outlet side or so as to apply a pulse voltage to lens electrodes on both the inlet side and the outlet side. In these configurations, the ions are attracted by an electric field formed by the pulse voltage applied to the lens electrodes so that they collide with the lens electrodes and disappear. In addition, by using a configuration in which pulse voltages with respectively reverse polarities are applied to the lens electrode on the inlet side and the lens electrode on the outlet side, the ions remaining in the collision cell are attracted by the electric field formed around the lens electrode to which a pulse voltage with the reverse polarity as the ions is applied and are repelled by the electric field formed around the lens electrode to which a pulse voltage with the same polarity as the ions is applied. As a result, it is possible to increase the movement speed of the ions and to remove the ions remaining in the collision cell in a short amount of time.

In addition, it is also possible to use a configuration in which a pulse voltage with the same polarity as the ions in the collision cell is applied to the lens electrode on the inlet side and/or the lens electrode on the outlet side and, in synchronization with this, the application of the high-frequency voltage to the ion guide in the collision cell is interrupted. When the application of the high-frequency voltage to the ion guide is interrupted, the restriction of the ions by the high-frequency electric field is eliminated. Therefore, the ions in the collision cell spread out more easily without being converged in the vicinity of the ion optical axis. At this time, if a pulse voltage with the same polarity as the ions is applied to the lens electrode, the ions move toward the ion guide having a relatively lower potential and then disappear when they make contact with the ion guide. The distance between the ions remaining in the collision cell and the ion guide is substantially shorter on average than the distance between the ions and the lens electrode, so the ions make contact with the ion guide in a short amount of time, which makes it possible to efficiently remove the ions remaining in the collision cell in a short amount of time.

With the MS/MS type mass spectrometer of the first invention, even if the suspension period during which measurements are essentially suspended in step with the switching of the mass-to-charge ratio of the precursor ions is short, it is possible to achieve a high detection sensitivity when performing measurements on the product ions derived from the next precursor ions. In addition, when the suspension period described above is long, the amount of remaining ions forcibly removed by the application of the pulse voltage becomes small, so it becomes possible to suppress the contamination of the lens electrode or the ion guide due to contact with the ions.

In addition, with the MS/MS type mass spectrometer of the second invention, even if the amount of ions remaining in the collision cell is large, it is possible to feed product ions derived from the next precursor ions from the collision cell into the next level after reliably removing these remaining ions. As a result, it is possible to reliably eliminate crosstalk.

It goes without saying that the first and second inventions may be used in combination. That is, it is possible to use a configuration in which the control means regulates the length of the delay time for generating a pulse voltage according to the length of the suspension period and regulates at least one of the peak value or the pulse width of the pulse voltage based on information reflecting the amount of ions remaining in the collision cell immediately before entering the suspension period.

BRIEF DESCRIPTION OF THE DRAWINGS

FIG. 1 is an overall schematic diagram of the MS/MS type mass spectrometer of an embodiment of the present invention.

FIG. 2 is a schematic diagram of the collision cell and the power supply system thereof in the MS/MS type mass spectrometer of this embodiment.

FIG. 3 is a graph showing an example of the relationship between the pulse voltage and changes in ionic strength in the MS/MS type mass spectrometer of this embodiment.

FIG. 4 is a graph showing another example of the relationship between the pulse voltage and changes in ionic strength in the MS/MS type mass spectrometer of this embodiment.

FIG. 5 is a graph showing another example of the relationship between the pulse voltage and changes in ionic strength in the MS/MS type mass spectrometer of this embodiment.

FIG. 6 is a graph showing another example of the relationship between the pulse voltage and changes in ionic strength in the MS/MS type mass spectrometer of this embodiment.

FIG. 7 is a schematic diagram of the collision cell and the power supply system thereof in the MS/MS type mass spectrometer of another embodiment.

FIG. 8 is a schematic diagram of the collision cell and the power supply system thereof in the MS/MS type mass spectrometer of another embodiment.

FIG. 9 is a schematic diagram of the collision cell and the power supply system thereof in the MS/MS type mass spectrometer of another embodiment.

FIG. 10 is a schematic diagram of the collision cell and the power supply system thereof in the MS/MS type mass spectrometer of another embodiment.

FIG. 11 is a schematic diagram of the collision cell and the power supply system thereof in the MS/MS type mass spectrometer of another embodiment.

FIG. 12 is an overall schematic diagram of a typical MS/MS type mass spectrometer.

FIG. 13 is a graph showing an example of changes in the strength of ions remaining in the collision cell over time in a conventional MS/MS type mass spectrometer.

FIG. 14 is a graph showing an example of changes in the strength of ions remaining in the collision cell over time in a conventional MS/MS type mass spectrometer.

DESCRIPTION OF THE EXEMPLARY EMBODIMENTS

Embodiments of the MS/MS type mass spectrometer of the present invention will be described hereinafter with reference to the attached drawings.

FIG. 1 is an overall schematic diagram of the MS/MS type mass spectrometer of this embodiment. FIG. 2 is a schematic diagram of the collision cell in FIG. 1 and the power supply system circuit thereof. FIGS. 3 and 4 are graphs showing other examples of the relationship between the pulse voltage and changes in ionic strength in the MS/MS type mass spectrometer of this embodiment. Components which are the same as those of the conventional configuration already described above are labeled with the same symbols, and descriptions thereof will be omitted here.

In the MS/MS type mass spectrometer of this embodiment, a collision cell 4 is disposed between a first quadrupole (corresponding to the first mass separating part of the present invention) 3 and a third quadrupole (corresponding to the second mass separating part of the present invention) 6 in order to split precursor ions and produce various product ions, and a second quadrupole 5 without a mass separating function is disposed therein. The first quadrupole 3 and the third quadrupole 6 are quadrupole mass filters, and the second quadrupole 5 is a simple quadrupole (or multipole) ion guide.

In the collision cell 4, a tubular body 41 which encapsulates the outside of the second quadrupole 5 is formed from an insulating member. An inlet side lens electrode 42 provided on the end surface of the ion-incident side of the tubular body 41 and an outlet side lens electrode 44 provided on the end surface on the ion-emitting side are both formed from conductive members such as metal. The inlet side lens electrode 42 and the outlet side lens electrode 44 are roughly circular ring-shaped members with openings 43 and 45 through which ions pass formed roughly in the center.

A voltage$\pm(U1+V1\cdot\cos\omega t)$ combining a direct-current voltage U1 and a high-frequency voltage $V1\cdot\cos\omega t$ or a voltage$\pm(U1+V1\cdot\cos\omega t)+Vbias1$ generated by further adding a prescribed direct-current bias voltage Vbias1 to this voltage is applied to the first quadrupole 3 from a first power supply part 11. Only a high-frequency voltage$\pm V2\cdot\cos\omega t$ or a voltage$\pm V2\cdot\cos\omega t+Vbias2$ generated by adding a prescribed direct-current bias voltage Vbias2 to this voltage is applied to the second quadrupole 5 from a second power supply part 12. A voltage$\pm(U3+V3\cdot\cos\omega t)$ combining a direct-current voltage U3 and a high-frequency voltage V3·cos ωt or a voltage±(U3+V3·cos ωt)+Vbias3 generated by further adding a prescribed direct-current bias voltage Vbias3 to this voltage is applied to the third quadrupole 6 from a third power supply part 13. The first through third power supply parts 11, 12, and 13 operate under the control of a control part 10.

A prescribed voltage is respectively applied to the inlet side lens electrode 42 and the outlet side lens electrode 44 from a direct-current power supply part 20. The direct-current power supply part 20 includes the function of a pulse voltage source 21 for generating a pulse voltage with a prescribed peak value for only a short amount of time in response to an instruction from the control part 10. In addition to the pulse voltage source 21, the direct-current power supply part 20 may also be configured so as to have a function for applying a prescribed direct-current bias voltage during periods when no pulse voltage is applied. In this example, it is presumed that positive ions are to be analyzed, and a pulse voltage with a negative polarity, which is the reverse polarity of positive ions, is applied. It can be easily understood that when negative ions are to be analyzed, a pulse voltage with a positive polarity, which is the reverse polarity of negative ions, is applied. The control part 10 comprises an analysis sequence setting part 101 for setting a sequence for executing analysis such as that described below and a pulse voltage parameter setting part 102 for setting parameters such as the generation timing, pulse width, and peak value of the pulse voltage produced by the pulse voltage source 21.

The characteristic control operation of the MS/MS type mass spectrometer of this embodiment will be described hereinafter. Here, a case is assumed in which an LC or a GC is connected to the front level of the mass spectrometer, a sample containing components which are separated over time by the LC or GC are introduced as time passes, and the components in the sample are successively detected by the MRM method. In MRM measurements, the mass-to-charge ratio A of precursor ions selected by the first quadrupole 3 and the mass-to-charge ratio a of product ions selected by the third quadrupole 6 (a<A) are fixed, and different values of A and a are set for each component to be measured. Accordingly, the switching of the mass-to-charge ratio of the product ions in the third quadrupole 6 is performed together with the switching of the mass-to-charge ratio of the precursor ions in the first quadrupole 3. The pair of mass-to-charge ratios of these precursor ions and product ions are associated with the retention time and set from an operation part 30 by an analyzer in advance as analysis conditions.

In the control part 10, the analysis sequence setting part 101 determines a sequence for executing analysis as time passes in accordance with the various analysis conditions set by the operation part 30. As a result, the length of a detection period (dwell time) or the length of the suspension period between two adjacent detection periods over time is determined. It is not necessary for the length of the detection period or suspension period to be constant from the start until the end of the measurements, and it is possible to use a configuration in which, for example, the detection period or suspension period is shortened when a plurality of components appear consecutively in a short amount of time and the detection period or suspension period is lengthened when the intervals between the appearances of components are wide.

When the length of the suspension period is determined, the pulse voltage parameter setting part 102 determines a delay time d according to the length of the suspension period. Basically, as shown in FIG. 3, a shorter delay time d is set for shorter suspension periods. That is, the delay time d is determined so that the time t2-t4 from the termination point t4 of a pulse voltage until the starting point t2 of the next detection period is at least a constant amount of time U and the pulse width p (=t4-t3) is a constant value. When the ionic strength is at a maximum, the constant amount of time U is preferably determined to be at least the amount of time required for the amount of ions in the collision cell 4 to recover from a state of zero to an amount corresponding to this maximum ionic strength.

At a given point, precursor ions with a mass-to-charge ratio of A1 are selected by the first quadrupole 3 and fed into the collision cell 4. Product ions are produced by collision-induced dissociation within the collision cell 4, and product ions having a mass-to-charge ratio a1 are selected by the third quadrupole 6 from among these product ions. Data based on a detection signal obtained as the selected product ions are made incident on the detector 7 is collected by a data processing part 8.

During a prescribed detection period, after data collection is executed using product ions with a mass-to-charge ratio a1 derived from precursor ions with a mass-to-charge ratio A1, the data processing part 8 temporarily interrupts data collection in accordance with the control of the control part 10. This is the starting point t1 of the suspension period. At the same time as the transition to the suspension period, the control part 10 issues an instruction to switch voltages in order to switch the respectively selected mass-to-charge ratios for the first power supply part 11 and the third power supply part 13. In response to this, the voltages respectively applied to the first quadrupole 3 and the third quadrupole 6 from the first power supply part 11 and the third power supply part 13 are switched, but at the starting point t1 of the suspension period, all of the ions become temporarily unable to pass through the first quadrupole 3 in step with this switch, and the introduction of ions into the collision cell 4 is interrupted. On the other hand, since the discharge of ions from within the collision cell 4 continues, the amount of ions remaining in the collision cell 4 starts to decrease (natural decrease), as shown in FIG. 3.

The control part 10 provides an instruction to the direct-current power supply part 20 to generate a pulse voltage with a prescribed peak value at the point t3 when the delay time d has passed from the starting point t1 of the suspension period, and the pulse voltage source 21 of the direct-current power supply part 20 applies a pulse voltage with a negative polarity to the outlet side lens electrode 44 in response to this instruction. As shown in FIG. 3 (a), if the suspension period is short, the delay time d is also relatively short, so the pulse voltage is applied to the outlet side lens electrode 44 while a large amount of ions still remain in the collision cell 4. The remaining ions (precursor ions and product ions) are attracted by a direct-current electric field formed temporarily inside the collision cell 4 in step with the application of the pulse voltage and are accelerated so as to collide with the outlet side lens electrode 44. The ions are then neutralized by receiving electrons from the outlet side lens electrode 44 and adhere to the surface of the outlet side lens electrode 44.

The ions remaining in the collision cell 4 move as a whole from the inlet side lens electrode 42 toward the direction of the outlet side lens electrode 44 due to the kinetic energy at the time of incidence, but as described above, the movement speed increases in a burst when the pulse voltage is applied. Therefore, roughly all of the remaining ions make contact with the outlet side lens electrode 44 in a short amount of time and are removed from the collision cell 4. The precursor ions after the switching of the mass-to-charge ratio begin to pass through the first quadrupole 3 around the termination point t4 of the pulse voltage. Therefore, when the application of the pulse voltage ends, the next precursor ions begin to be introduced into the collision cell 4 from which the remaining ions have been cleared by the pulse voltage, and product ions produced by the splitting of the precursor ions begin to accumulate inside the collision cell 4. As a result, as shown in FIG. 13 (*a*), the ionic strength rapidly begins to recover from a state in which the ionic strength has temporarily dropped to approximately zero. However, this point is still within the suspension period, and data collection by the data processing part 8 is not yet started.

Of the product ions derived from the precursor ions after the switching of the mass-to-charge ratio produced in the collision cell 4, only ions having a prescribed mass-to-charge ratio pass through the third quadrupole 6 and reach the detector 7. Accordingly, the recovery of product ions detected by the detector 7 from the state in which the ionic strength has dropped to zero is slightly delayed with respect to the recovery of the amount of ions remaining in the collision cell 4. However, here, the amount of time from the termination point t4 of the pulse voltage until the starting point t2 of the detection period is set to at least a constant amount of time, so the ionic strength according to the detector 7 has sufficiently recovered at the starting point of the next detection period, and the data processing part 8 collects data corresponding to this high ionic strength. As a result, it is possible to detect product ions with high sensitivity after the mass-to-charge ratio of the precursor ions is switched.

On the other hand, if the suspension period is long, as shown in FIG. 3 (*b*), the delay time d becomes relatively long, so the amount of ions remaining in the collision cell 4 greatly decreases naturally during this period. In the example shown in this figure, the amount of remaining ions drops to approximately zero. Therefore, when a pulse voltage with a negative polarity is applied, the amount of ions which are removed as they make contact with the outlet side lens electrode 44 due to the action of an electric field formed by the voltage is extremely small. As a result, there is a smaller amount of contamination of the lens electrode 44 due to the adhesion of ions in comparison to the case in which the suspension period is short. Of course, the fact that the amount of product ions reaching the detector 7 sufficiently recovers by the starting point of the next detection period is the same as in the case in which the suspension period is short.

In FIG. 3, the peak value of the pulse voltage is set to V1, but it is preferable to change the peak value according to the amount of ions remaining in the collision cell 4. Since the immediately preceding amount of ions remaining in the collision cell 4 depends primarily on the concentration of the components measured immediately before, this amount is unknown prior to measurements. Accordingly, in contrast to the delay time, this cannot be set in advance by the pulse voltage parameter setting part 102 and must be determined adaptively during measurements. In MRM measurements, the mass-to-charge ratios of the precursor ions and the product ions are determined in accordance with the components to be measured so that the components can be detected, so the ionic strength obtained by the detector 7 can be considered to be roughly proportional to the amount of ions remaining in the collision cell 4. Therefore, the control part 10 receives ionic strength data roughly in real time from the data processing part 8 during measurements and determines the peak value of the pulse voltage generated during the suspension period based on the ionic strength data immediately before entering the suspension period. That is, the peak value of the pulse voltage is made large as the ionic strength becomes higher (see FIG. 4 (*a*)), and the peak value of the pulse voltage is made small when the ionic strength is low (see FIG. 4 (*b*)).

When the peak value of the pulse voltage is made large, the potential gradient of the direct-current electric field formed in the collision cell 4 as a result becomes steep, and a larger amount of kinetic energy is provided to the ions. As a result, the movement speed of the ions increases, and a commensurate amount of ions are removed rapidly from the collision cell 4. This means that the slope of the decrease in the ionic strength shown in FIG. 4 (*a*) becomes steep. Accordingly, even with the same pulse width, it is possible to remove a commensurately large amount of ions, and even if the amount of remaining ions is large, it is possible to reduce the amount of ions to approximately zero by applying a pulse voltage. As a result, it is possible to suppress crosstalk even if the amount of remaining ions is large. On the other hand, since the peak value of the pulse voltage becomes small when the amount of remaining ions immediately before entering the suspension period is small, the kinetic energy of the ions making contact with the outlet side lens electrode 44 becomes low, which increases the likelihood of being discharged without adhering to the surface of the lens electrode 44 even after being neutralized. It is therefore possible to reduce the contamination of the lens electrode 44.

As described above, in the MS/MS type mass spectrometer of this embodiment, in a suspension period established between detection periods in step with the switching of the mass-to-charge ratios of the precursor ions and product ions, the timing for generating a pulse voltage for removing the ions remaining in the collision cell 4 is changed based on the length of the suspension period, which enables the detection of product ions with sufficiently high sensitivity from the outset of the detection period. Moreover, if the suspension period is long, it is possible to reduce the contamination of the lens electrode caused by ion adhesion by reducing forced ion removal. In addition, although the amount of ions remaining in the collision cell 4 when entering the suspension period differs depending on the concentration of the sample components, changing the peak value of the pulse voltage according to the ionic strength, which reflects the amount of remaining ions, makes it possible to prevent the occurrence of crosstalk by reliably removing remaining ions, regardless of the amount of remaining ions.

FIG. 5 is a graph showing the relationship between the pulse voltage and changes in ionic strength in a variation configured so that remaining ions are reliably removed by changing the pulse width p instead of changing the peak value of the pulse voltage when the amount of remaining ions is large, as in the embodiment described above. In this case, the ion removal speed does not differ from that of the case shown in FIG. 3, but the width p of the pulse voltage is widened, which makes it possible to remove more ions. However, by widening the width p of the pulse voltage, the amount of time from the termination point t4 of the pulse voltage until the starting point t2 of the next detection period becomes short, which is undesirable, so it is preferable to determine the amount of time t2-t4 in advance while taking into consideration the maximum pulse width or to widen the pulse width p so as to cut the delay time d.

FIG. 6 is a graph showing the relationship between the pulse voltage and changes in ionic strength in a case in which the suspension period is short and the ionic strength immediately before entering the suspension period is large. In this case, in order to maximize the peak value of the pulse voltage to reliably remove crosstalk and to prevent decreases in the sensitivity in the initial stages of the detection period, the delay time d is made as large as possible and the pulse width is made as narrow as possible within a range that enables the complete removal of crosstalk. In this way, by combining the regulation of the delay time d and the regulation of the peak value and the pulse width of the pulse voltage as described above, it is possible to minimize crosstalk, to maximize detection sensitivity, and to keep the contamination of the lens electrode and the like to a minimum under limited analysis conditions.

Moreover, in the embodiment described above, the pulse voltage for removing remaining ions was applied only to the outlet side lens electrode 44, but the configuration inside the collision cell 4 and the target of the application of the pulse voltage can be applied to any of the various modes disclosed in Patent Literature 2 (International Publication No. 2009/095958 Pamphlet). FIGS. 7-11 are schematic configuration diagrams of these modes.

In the example shown in FIG. 7, the periphery of the opening 47 of an outlet side lens electrode 46 to which a pulse voltage is applied is formed with a skimmer shape projecting into the collision cell 4, which makes it easy for a direct-current electric field to move inside the second quadrupole 5.

In the example shown in FIG. 8, the same pulse voltage as that applied to the outlet side lens electrode 44 is also applied to the inlet side lens electrode 42, which makes it possible to remove residual ions from the collision cell 4 more rapidly by reducing the movement distance of ions to reach the lens electrodes 42 and 44.

In the example shown in FIG. 9, the direct-current power supply part 20 is provided with a second pulse voltage source 22 for generating a pulse voltage with the reverse polarity as that of the pulse voltage generated by the first pulse voltage source 21. By applying a pulse voltage with a positive polarity to the inlet side lens electrode 42 with the same timing as that used to apply a pulse voltage with a negative polarity to the outlet side lens electrode 44, it is possible to form an electric field with a steep gradient inside the collision cell 4 and to further increase the speed of ions traveling toward the outlet side lens electrode 44.

In the example shown in FIG. 10, in order to advance the ions remaining in the collision cell 4 toward the second quadrupole 5, the direct-current power supply part 20 is provided with a pulse voltage source 23 for generating a pulse voltage with the same polarity as the ions. The second power supply part 12 has a configuration in which the output voltage of a direct-current bias voltage source 123 and the output voltage of a high-frequency voltage source 122 are added by an addition part 124 and outputted, but at approximately the same time as the application of the pulse voltage described above, the generation of the high-frequency voltage by the high-frequency voltage source 122 is temporarily interrupted by opening a switch 126. At this time, only a direct-current bias voltage lower than the pulse voltage is applied to the second quadrupole 5. Therefore, the converging action of the high-frequency electric field on ions present in the collision cell 4 is eliminated, and the large amount of ions assembled in the vicinity of the ion optical axis immediately before spread out into the surrounding area. In the space between the lens electrode 44 and the second quadrupole 5, a direct-current potential gradient which decreases from the former to the latter is formed. Therefore, ions which have been relieved of the converging action of the high-frequency electric field advance toward the second quadrupole 5 and are neutralized as they make contact with the second quadrupole 5. For the ions remaining in the collision cell 4, the distance to reach the second quadrupole 5 is quite short on average in comparison to the distances to reach the lens electrodes 42 and 44. Accordingly, when a pulse voltage is applied, the ions reach the second quadrupole 5 in a short amount of time and are thus removed efficiently.

In the example shown in FIG. 11, both an inlet side lens electrode 48 and an outlet side lens electrode 46 are formed with skimmer shapes, and a pulse voltage identical to that of the outlet side lens electrode 44 with the same polarity as the ions is also applied to the inlet side lens electrode 42. As a result, it is possible to more rapidly remove ions present in the vicinity of the ion optical axis by moving them towards the second quadrupole 5 and bringing them into contact with the second quadrupole 5.

Each embodiment described above is an example of the present invention, so it is clear that any variations, additions, and modifications made appropriately within the scope of the gist of the present invention are also included in the scope of the patent claims of this application.

EXPLANATION OF REFERENCES

1 . . . analysis chamber
2 . . . ion source
3 . . . first quadrupole
4 . . . collision cell
41 . . . tubular body
42, 48 . . . inlet side lens electrodes
43, 47 . . . openings
44, 46 . . . outlet side lens electrodes
5 . . . second quadrupole
6 . . . third quadrupole
7 . . . detector
8 . . . data processing part
10 . . . control part
101 . . . analysis sequence setting part
102 . . . pulse voltage parameter setting part
11 . . . first power supply part
12 . . . second power supply part
122 . . . high-frequency voltage source
123 . . . direct-current bias voltage source
124 . . . addition part
126 . . . switch
13 . . . third power supply part
20 . . . direct-current power supply part
21 . . . first pulse voltage source
22 . . . second pulse voltage source
23 . . . pulse voltage source
30 . . . operation part

What is claimed is:

1. An MS/MS type mass spectrometer equipped with a first mass separating part for selecting ions having a specific mass-to-charge ratio as precursor ions from among various ions, a collision cell for splitting said ions by causing said precursor ions to collide with a prescribed gas, said collision cell having an ion guide for converging and transporting ions with a high-frequency electric field, a second mass separating part for selecting ions having a specific mass-to-charge ratio from among various product ions produced by the splitting of said precursor ions, and a detector for detecting the product ions selected by said second mass separating part, said MS/MS type mass spectrometer being provided with:

a) a lens electrode having an ion-passing opening provided on at least one of the inlet side and outlet side of said collision cell;

b) a voltage application means for applying a pulse voltage to the lens electrode on said inlet side and/or said outlet side for attracting or repelling said ions in said collision cell; and c) a control means which controls said voltage application means so as to generate the pulse voltage during a suspension period in which the convergence of detection data by said detector is suspended in step with the switching of the mass-to-charge ratio of precursor ions in said first mass separating part, and generate the pulse voltage at a point when a prescribed delay time has passed after the starting point of said suspension period and regulates the length of said delay time according to the length of said suspension period;

wherein the delay time is regulated so that a time from termination of application of the pulse voltage to termination of the suspension period is set in advance to at least a prescribed value, the prescribed value set to a constant amount of time so that an ionic strength of the detector recovers by the termination of the suspension period.

2. An MS/MS type mass spectrometer equipped with a first mass separating part for selecting ions having a specific mass-to-charge ratio as precursor ions from among various ions, a collision cell for splitting said ions by causing said precursor ions to collide with a prescribed gas, said collision cell having an ion guide for converging and transporting ions with a high-frequency electric field, a second mass separating part for selecting ions having a specific mass-to-charge ratio from among various product ions produced by the splitting of said precursor ions, and a detector for detecting the product ions selected by said second mass separating part, said MS/MS type mass spectrometer being provided with:

a) a lens electrode having an ion-passing opening provided on at least one of the inlet side and outlet side of said collision cell;

b) a voltage application means for applying a pulse voltage to the lens electrode on said inlet side and/or said outlet side for attracting or repelling said ions in said collision cell; and c) a control means which controls said voltage application means so as to generate the pulse voltage during a suspension period in which the convergence of detection data by said detector is suspended in step with the switching of the mass-to-charge ratio of precursor ions in said first mass separating part, and regulates at least one of the peak value or the pulse width of said pulse voltage based on information reflecting the amount of remaining ions in the collision cell immediately before entering said suspension period, wherein a time from termination of application of the pulse voltage to termination of the suspension period is set in advance to at least a prescribed value, the prescribed value set to a constant amount of time so that an ionic strength of the detector recovers by the termination of the suspension period.

3. The MS/MS type mass spectrometer according to claim 2, wherein said information reflecting the amount of remaining ions is based on the ionic strength obtained by said detector.

4. A method of performing mass spectrometry comprising the steps of:

providing an MS/MS type mass spectrometer equipped with a first mass separating part for selecting ions having a specific mass-to-charge ratio as precursor ions from among various ions, a collision cell for splitting said ions by causing said precursor ions to collide with a prescribed gas, said collision cell having an ion guide for converging and transporting ions with a high-frequency electric field, a second mass separating part for selecting ions having a specific mass-to-charge ratio from among various product ions produced by the splitting of said precursor ions, a detector for detecting the product ions selected by said second mass separating part, and a lens electrode having an ion-passing opening provided on at least one of the inlet side and outlet side of said collision cell;

applying a pulse voltage to the lens electrode on said inlet side and/or said outlet side for attracting or repelling said ions in said collision cell; wherein the pulse voltage is generated during a suspension period in which the convergence of detection data by said detector is suspended in step with the switching of the mass-to-charge ratio of precursor ions in said first mass separating part, and the pulse voltage is generated at a point when a prescribed delay time has passed after the starting point of said suspension period; and regulating the length of said delay time according to the length of said suspension period;

wherein the delay time is regulated so that a time from termination of application of the pulse voltage to termination of the suspension period is set in advance to at least a prescribed value, the prescribed value set to a constant amount of time so that an ionic strength of the detector recovers by the termination of the suspension period.

5. A method of performing mass spectrometry comprising the steps of:

providing an MS/MS type mass spectrometer equipped with a first mass separating part for selecting ions having a specific mass-to-charge ratio as precursor ions from among various ions, a collision cell for splitting said ions by causing said precursor ions to collide with a prescribed gas, said collision cell having an ion guide for converging and transporting ions with a high-frequency electric field, a second mass separating part for selecting ions having a specific mass-to-charge ratio from among various product ions produced by the splitting of said precursor ions, a detector for detecting the product ions selected by said second mass separating part, and a lens electrode having an ion-passing opening provided on at least one of the inlet side and outlet side of said collision cell;

applying a pulse voltage to the lens electrode on said inlet side and/or said outlet side for attracting or repelling said ions in said collision cell; wherein the pulse voltage is generated during a suspension period in which the convergence of detection data by said detector is suspended in step with the switching of the mass-to-charge ratio of precursor ions in said first mass separating part; and regulating at least one of the peak value or the pulse width of said pulse voltage based on information reflecting the amount of remaining ions in the collision cell immediately before entering said suspension period, wherein a time from termination of application of the pulse voltage to termination of the suspension period is set in advance to at least a prescribed value, the prescribed value set to a constant amount of time so that an ionic strength of the detector recovers by the termination of the suspension period.

6. The method of performing mass spectrometry according to claim 5, wherein said information reflecting the amount of remaining ions is based on the ionic strength obtained by said detector.

* * * * *